US011737562B2

(12) United States Patent
Purchas et al.

(10) Patent No.: US 11,737,562 B2
(45) Date of Patent: Aug. 29, 2023

(54) PORTABLE SEAT

(71) Applicant: Aspiire Limited, London (GB)

(72) Inventors: Jamie Purchas, Croydon (GB); Michael Purchas, Trowbridge (GB)

(73) Assignee: Aspiire Limited, London (GB)

( * ) Notice: Subject to any disclaimer, the term of this patent is extended or adjusted under 35 U.S.C. 154(b) by 265 days.

(21) Appl. No.: 17/205,802

(22) Filed: Mar. 18, 2021

(65) Prior Publication Data

US 2022/0248854 A1 Aug. 11, 2022

Related U.S. Application Data

(60) Provisional application No. 63/147,929, filed on Feb. 10, 2021.

(51) Int. Cl.
*A47C 1/16* (2006.01)
*A47C 7/62* (2006.01)
(Continued)

(52) U.S. Cl.
CPC ..... *A47C 1/16* (2013.01); *A45F 3/14* (2013.01); *A47C 4/42* (2013.01); *A47C 7/624* (2018.08); *A45F 2003/142* (2013.01)

(58) Field of Classification Search
CPC ..... A45F 3/14; A45F 4/02; A45F 2003/142; A45F 2004/026; A47C 1/16; A47C 4/42; A47C 4/52; A47C 7/624
See application file for complete search history.

(56) References Cited

U.S. PATENT DOCUMENTS 633,012 A * 9/1899 Kidd et al. ..... A47C 1/16 297/380
859,560 A * 7/1907 Hyde ..... A47C 1/16 297/352

(Continued)

FOREIGN PATENT DOCUMENTS

CN 212368646 U * 1/2021 ..... A47C 1/16
GB 2595440 A * 12/2021 ..... A47C 1/12

OTHER PUBLICATIONS https://www.amazon.com/Alpcour-Reclining-Stadium-Armrests-Shoulder/dp/B07FWCQNDY?th=1, Date First Available Nov. 3, 2018, ('Alpcour'), accessed on Jan. 31, 2022 (Year: 2018).*

(Continued)

*Primary Examiner* — James M Ference
(74) *Attorney, Agent, or Firm* — Anooj Patel; Heber Martin Carbajal; Hankin Patent Law APC

(57) ABSTRACT

A portable seat, comprising an internal frame; a cover; and one or more hook assemblies; wherein said internal frame is encased by said cover; wherein said one or more hook assemblies comprise a hook, biasing element, and anchoring element; wherein said one or more hook assemblies engage said internal frame at an engagement area via said anchoring elements; wherein said cover comprises one or more holes through which said one or more hooks protrude; wherein said biasing elements applies a force to said hooks such that said hooks pivot at said engagement area and said hooks rest against said cover; wherein said one or more holes are not configured to be sealed; and wherein said hooks are configured to engage a front surface of a bench by pivoting away from said cover and extending orthogonally relative to said cover.

2 Claims, 10 Drawing Sheets

(51) Int. Cl.
*A47C 4/42* (2006.01)
*A45F 3/14* (2006.01)

(56) References Cited

U.S. PATENT DOCUMENTS 1,293,778 A * 2/1919 Holm ..... A47C 1/16 297/352
1,468,872 A * 9/1923 Beskow ..... A47C 1/16 297/440.11
1,809,392 A * 6/1931 Ponten ..... A47C 1/16 297/252
2,220,865 A * 11/1940 Hines ..... A47C 1/16 297/352
2,475,962 A * 7/1949 Horn ..... A47C 1/16 297/252
2,509,420 A * 5/1950 Burch ..... A47C 1/16 297/252
2,518,971 A * 8/1950 Zillig ..... B63B 17/00 297/352
2,542,820 A * 2/1951 Legois ..... A47C 1/16 297/352
2,647,563 A * 8/1953 Bishop ..... A47C 1/16 297/352
2,736,365 A * 2/1956 Hines ..... A47C 1/16 297/352
2,740,466 A * 4/1956 Du Priest ..... A47C 1/16 297/188.2
2,957,515 A * 10/1960 Gibson ..... A47C 1/16 297/440.11
3,026,142 A * 3/1962 Holloway ..... A47C 1/16 297/352
3,066,980 A * 12/1962 Clute ..... A47C 1/16 297/352
3,594,039 A * 7/1971 Harp ..... A47C 7/66 297/188.1
3,994,529 A * 11/1976 Lippert ..... A47C 1/16 297/134
4,715,652 A * 12/1987 Ward ..... A47C 1/16 297/252
4,781,413 A * 11/1988 Shumack, Jr. ..... A47C 7/021 297/DIG. 3
5,069,503 A * 12/1991 Martinez ..... A47C 1/146 297/378.12
5,580,130 A * 12/1996 Williams ..... A47C 1/16 297/352
5,934,751 A * 8/1999 Johnson ..... A47C 1/16 297/252
6,502,902 B1 * 1/2003 Romero ..... A47C 1/16 297/352
6,565,154 B2 * 5/2003 Davis ..... A47C 7/42 297/487
6,966,464 B2 * 11/2005 Betkowski ..... A47C 7/02 222/192
7,125,079 B1 * 10/2006 Lee ..... A47C 15/004 297/130
7,316,452 B2 * 1/2008 Vestweber ..... A47C 1/16 297/352
7,438,302 B2 * 10/2008 Nichols ..... B62K 13/00 297/352
7,819,484 B2 * 10/2010 Conforti ..... A47C 31/126 297/452.21
8,011,194 B2 * 9/2011 Dimmitt ..... A47C 4/52 62/115
8,075,059 B2 * 12/2011 Kim ..... A47C 1/146 297/378.12
9,737,145 B1 * 8/2017 Butler ..... A47C 4/18
9,936,811 B2 * 4/2018 Rowe, Jr. ..... E04H 15/02
10,624,456 B2 * 4/2020 Fernandez ..... A47C 7/021
2005/0035639 A1 * 2/2005 Jones ..... A47C 1/16 297/352
2006/0022499 A1 * 2/2006 Jones ..... A47C 1/16 297/352
2007/0018491 A1 * 1/2007 Jones ..... A47C 1/16 297/352
2008/0122268 A1 * 5/2008 Kim ..... A47C 1/146 297/16.2
2009/0079244 A1 * 3/2009 Kelleher ..... A47C 1/16 297/257
2009/0212614 A1 * 8/2009 Isaac ..... A47C 1/16 297/252
2010/0045078 A1 * 2/2010 Lee ..... A47C 7/407 297/188.1
2010/0237667 A1 * 9/2010 Guy ..... A47C 1/146 297/229
2012/0098307 A1 * 4/2012 Whittington ..... A47C 9/06 297/217.7
2012/0305616 A1 * 12/2012 Smith ..... F41B 5/1461 224/614
2017/0164752 A1 * 6/2017 Partridge ..... A47C 1/16
2019/0104829 A1 * 4/2019 Clary ..... A45F 4/02
2019/0231074 A1 * 8/2019 Grace ..... A45F 3/14
2020/0405055 A1 * 12/2020 Sun ..... A47C 7/543
2021/0298479 A1 * 9/2021 Sun ..... A47C 4/30
2022/0248854 A1 * 8/2022 Purchas ..... A45F 4/02

OTHER PUBLICATIONS https://web.archive.org/web/20200928205631/https://alpcour.com/product/alpcour-folding-stadium-seat-3/, published on Sep. 28, 2020, accessed on Jan. 31, 2022 (Year: 2020).* https://www.amazon.com/Brawntide-Wide-Stadium-Seat-Bleachers/dp/B079LBGCWJ/ref=sr_1_8?crid=2CND5XTFET4BE&keywords=bleacher%2Bseat%2Bwith%2Bhook&qid=1675273188&sprefix=bleacher%2Bseat%2Bwith%2Bhook%2Caps%2C120&sr=8-8&th=1, Date First Available May 20, 2018 ('Brawntide'), accessed on Jan. 31, 2022 (Year: 2018).* amazon.com/Double-Heated-Stadium-Bleachers-Support/dp/B08TMCGZ6W/ref=sr_1_30_sspa?crid=13CW0PF9F30VO&keywords=stadium%2Bseat%2Bwith%2Bhook&qid=1675273126&s=sporting-goods&sprefix=stadium%2Bseat%2Bwith%2Bhook%2Csporting%2C114&sr=1-30-spons&spLa=ZW5jcnlwdGVkUXVhbGlmaWVyPUE2MlhXOTZZQ0JHOVAmZW5, Jan. 20, 2021 (Year: 2021).*

Alpcour Folding Stadium Seat—25-inch Extra Wide Padded Adults Camping Reclining Waterproof Bleacher Chair—Best Ultra Extra Thick Lightweight Back Support Cushion Seats for Bleachers w/Arm Rest, https://www.amazon.com/dp/B07PPCCLDQ?tag=gistg-20&linkCode=ogi&th=1&psc=1.

* cited by examiner

PORTABLE SEAT

CROSS REFERENCE PARAGRAPH

This U.S. Non-Provisional Patent application claims the benefit of U.S. Provisional Patent Application No. 63/147,929, filed on Feb. 10, 2021, titled "PORTABLE SEAT", by inventor Jamie Purchas, the contents of which are expressly incorporated herein by this reference as though set forth in their entirety.

FIELD OF INVENTION

Field of Use

The present disclosure generally relates to portable seats, and more specifically a portable seat having hooks affixed to an inner frame configured to engage a stadium bench.

Background

Many people find stadium seating or other bench style seating to be uncomfortable. As a result, there are a number of options for portable seats to make sitting on stadium or bench style seat more comfortable. These options generally include some sort of cushion and covering with a mechanism for securing the portable seat to the stadium seat. Some products also use a backrest and armrest in order to increase comfort.

Generally, there are two mechanisms for securing the portable seat to the stadium seat. First, a strap is often used to essentially tie the portable seat to the stadium seat. The other mechanism for securing the portable seat to the stadium seat is by using hooks mounted on a lower portion of the portable seat that engage a front lip of the stadium seat.

For portable seats that have their metal frames encased in fabric, use of a strap with buckle/clip is generally favored as a mechanism for securing it to a stadium seat, but this has certain drawbacks. For example, the strap which is stitched to the seat fabric can rip/tear off the fabric if excessive force is applied to it when a user leans against a backrest or the stitching of the strap comes apart over time through constant use. Alternatively, the hooks may be affixed to an internal metal frame of the portable seat, but a drawback to that configuration is that the covering must be removed or opened in some way in order for the user to remove the hook from the covering and make it accessible. By requiring the cover to be removed or opened in some way, the internal components, including the cushion, are likely to accumulate dirt and other materials. Also, exposing the internal components of the portable seat can allow water/moisture to enter in, which subsequently can cause mold to take hold on the inner padding if not dried out. Portable seats are often used during wet conditions outdoors.

What is needed is a portable seat that is able to secure itself to a stadium seat while having a compact profile when not in use, and mechanisms of securing the seat that are sturdy and prevent unnecessary wear or dirt accumulation in the chair.

SUMMARY OF EMBODIMENTS

Various embodiments of the present disclosure may be directed to a portable seat. The portable seat may comprise a rigid internal frame, cushion, cover, and rigid hooks.

In one embodiment, a portable seat may comprise an internal frame; a cover; and one or more hook assemblies; wherein the internal frame may be encased by the cover; wherein the one or more hook assemblies may comprise a hook, biasing element, and anchoring element; wherein the one or more hook assemblies may engage the internal frame at an engagement area via the anchoring elements; and wherein the cover comprises one or more holes through which the one or more hooks traverse. The biasing element may apply a force to the hooks such that the hooks pivot at the engagement area and the hooks rest against the cover. The one or more holes may be not configured to be sealed. The hooks may be configured to may engage a front surface of a bench by pivoting away from the cover and extending orthogonally relative to the cover. The portable seat may further comprise a cushion encased within the cover. The internal frame may be rigid. The internal frame may be metal. The internal frame may comprise a plurality of hinges, such that the portable seat comprises a flat configuration and a seated configuration. The portable seat may further comprise carrying straps. The carrying straps may be affixed to an outside surface of the cover. The carrying straps may be affixed to the internal frame.

In some embodiments the rigid hooks may be securely attached to the internal frame, extend passed the cover, and be biased or spring-loaded such that the hooks are biased toward laying flat against an outer portion of the cover.

Other features and advantages are inherent in the replica human foot shoe fit testing device claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

Figure 1:
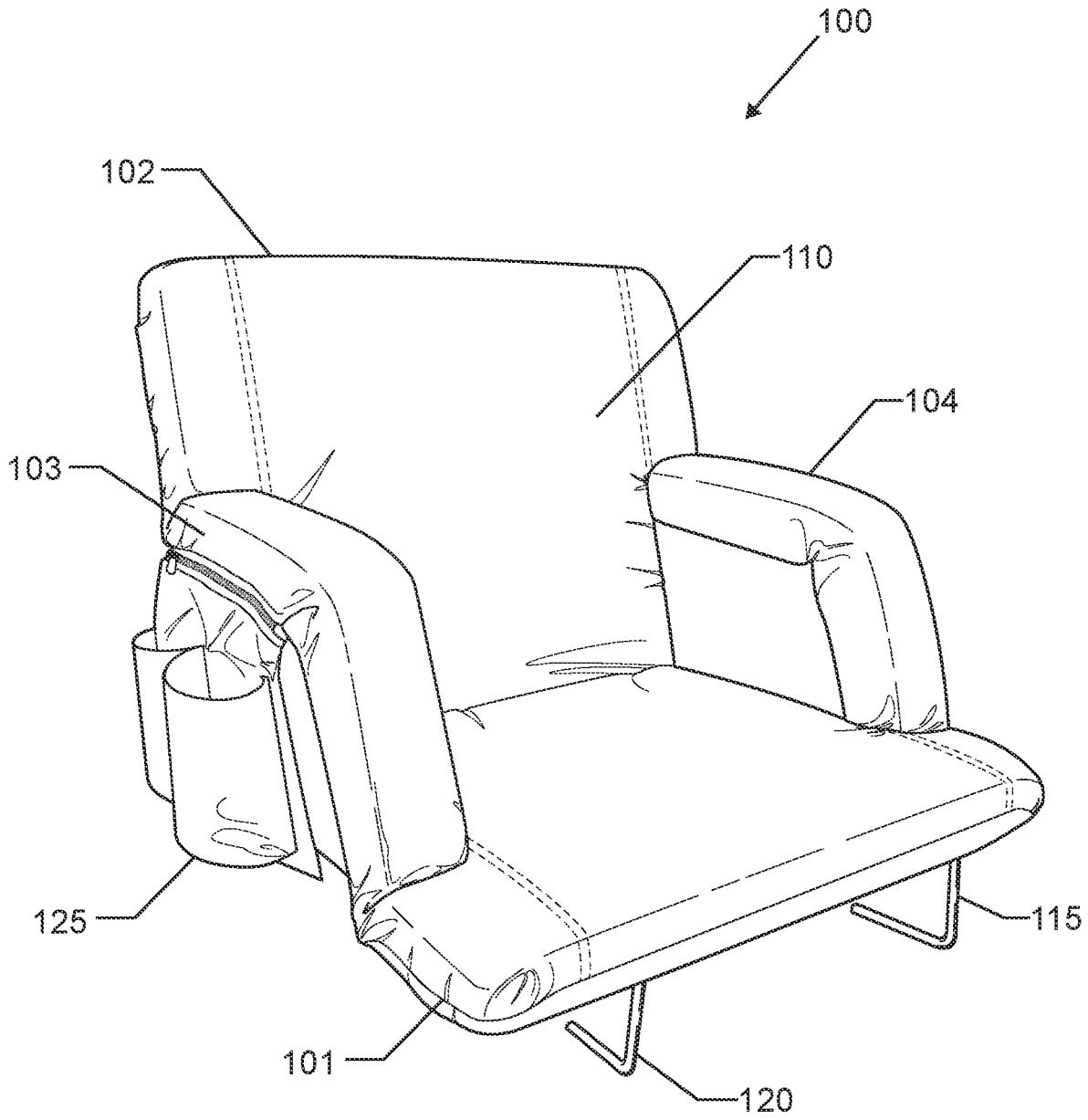
FIG. 1 is an illustration of a front perspective view of one embodiment of a portable seat in a seating configuration.

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As is used in the specification and the appended claims, the singular forms "a," "an," and "the" include plural referents unless the context clearly dictates otherwise. Ranges expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. In the following detailed description, numerous specific details are set forth in order to provide a thorough understanding of various aspects of one or more embodiments. However, these embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screenshots, figures, and the detailed descriptions thereof, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 15% of the indicated number or range of numbers. In one embodiment, the term "approximately" and "about", refer to a deviance of between 0.0001-40% from the indicated number or range of numbers.

Embodiments of the present invention will now be described, by way of example, with reference to the accompanying drawings.

FIG. 1 is an illustration of a front perspective view of one embodiment of a portable seat in a seating configuration. As shown in FIG. 1, the portable seat 100 may comprise an internal frame 105 (shown in FIGS. 7-10) that may be encased in a cover 110, a first hook 115, a second hook 120, and pockets 125. In one embodiment, the portable seat 100 may be configured to be secured to a stadium seat via the first and second hooks 115, 120.

The portable seat may comprise a bottom portion 101 (the seat), a top portion 102 (the back), and armrests 103, 104.

Figure 2:
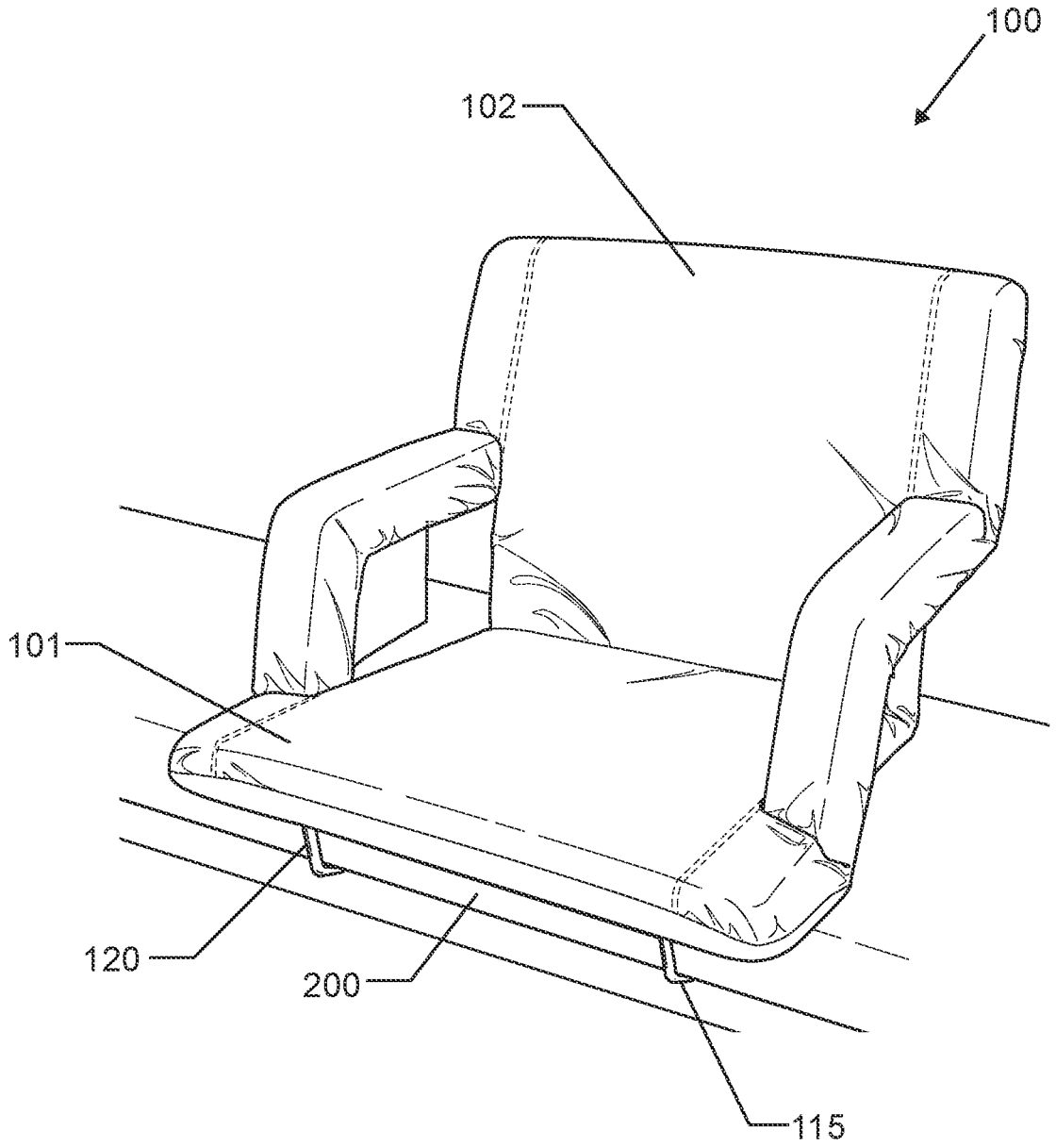
FIG. 2 is an illustration of a front perspective view of one embodiment of a portable seat in a seating configuration engaging a flat surface.

FIG. 2 is an illustration of a front perspective view of one embodiment of a portable seat in a seating configuration engaging a flat surface. As shown in FIG. 2, the portable seat 100 may engage a flat surface 200 via the hooks 115, 120. As shown in FIG. 2, the hooks 115, 120 may extend downward from a bottom portion 101 of the portable seat 100 when in a deployed configuration. In this deployed configuration, the hooks 115, 120 may be long enough such that the length of the first leg of the hooks 115, 120 may be the greater than or equal to a thickness of the flat surface 200 with which a user intends to engage the portable seat 100. In some embodiments, the flat surface 200 may be a bench, stadium seat, bleacher, or other elevated surface whose purpose may be to be sat upon. Preferably, the hooks 115, 120 may engage the flat surface 200 such that when a user sits on the portable seat 100, the hooks 115, 120 prevent the portable seat 100 from moving at least in a rearward direction, thereby stabilizing the portable seat 100 on the flat surface 200. In a preferred embodiment, the user may lean against the top portion 102, such that the top portion 102 acts as a backrest, and the hooks 115, 120 may prevent the portable seat 100 from tipping over or sliding in a rearward direction.

Figure 3:
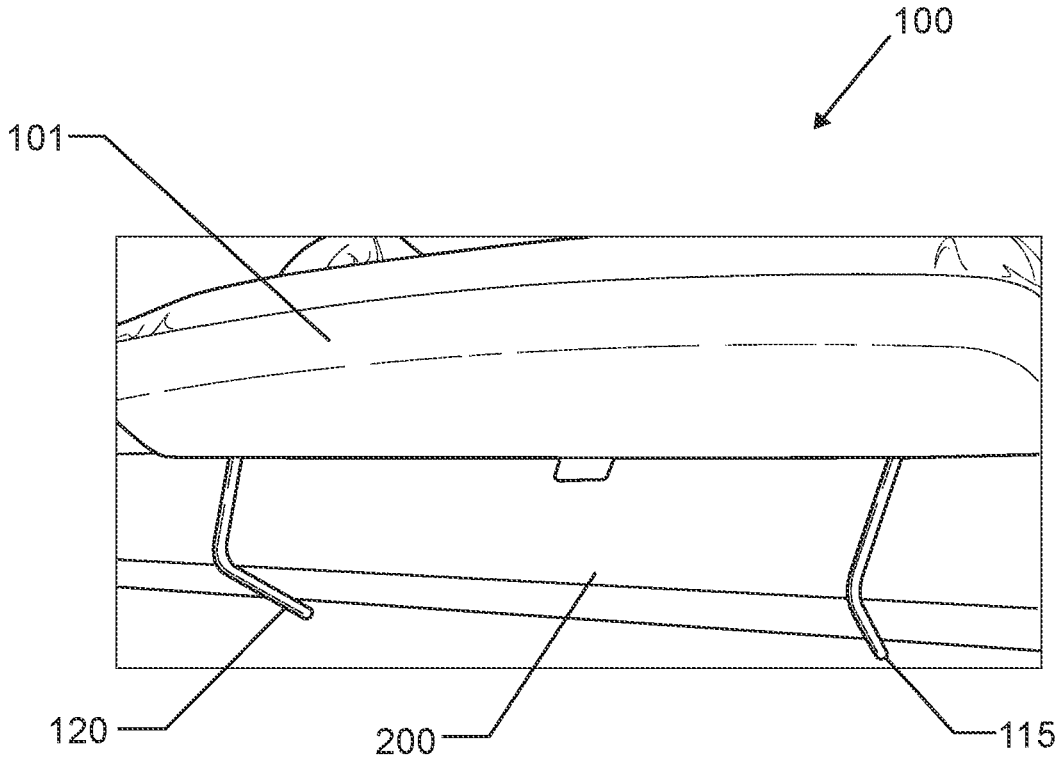
FIG. 3 is an illustration of one embodiment of a portable seat utilizing hooks to engage a flat surface.

FIG. 3 is an illustration of one embodiment of a portable seat utilizing hooks to engage a flat surface. In one embodiment, the hooked ends of the hooks 115, 120 may be approximately 10 centimeters away from the bottom portion of the portable seat 100 when the hooks 115, 120 are in a deployed configuration. The length of the distance from the bottom portion 101 of the portable seat 100 to the end of the hooks 115, 120, when the hooks 115, 120 are in a deployed configuration may be complementary to the thickness of the flat surface 200. In alternate embodiments, the hooked end of the hooks 115, 120 may be approximately 6-12 centimeters away from the bottom portion 101 of the portable seat 100 when the hooks 115, 120 are in a deployed configuration. In a preferred embodiment, the hooked end of the hooks 115, 120 may be approximately 7.5 centimeters away from the bottom portion 101 of the portable seat 100 when the hooks 115, 120 are in a deployed configuration.

In some embodiments, the end of the hooks 115, 120, when measured from the bottom portion 101 of the portable seat 100 may be greater than the thickness of the flat surface 200.

Figure 4:
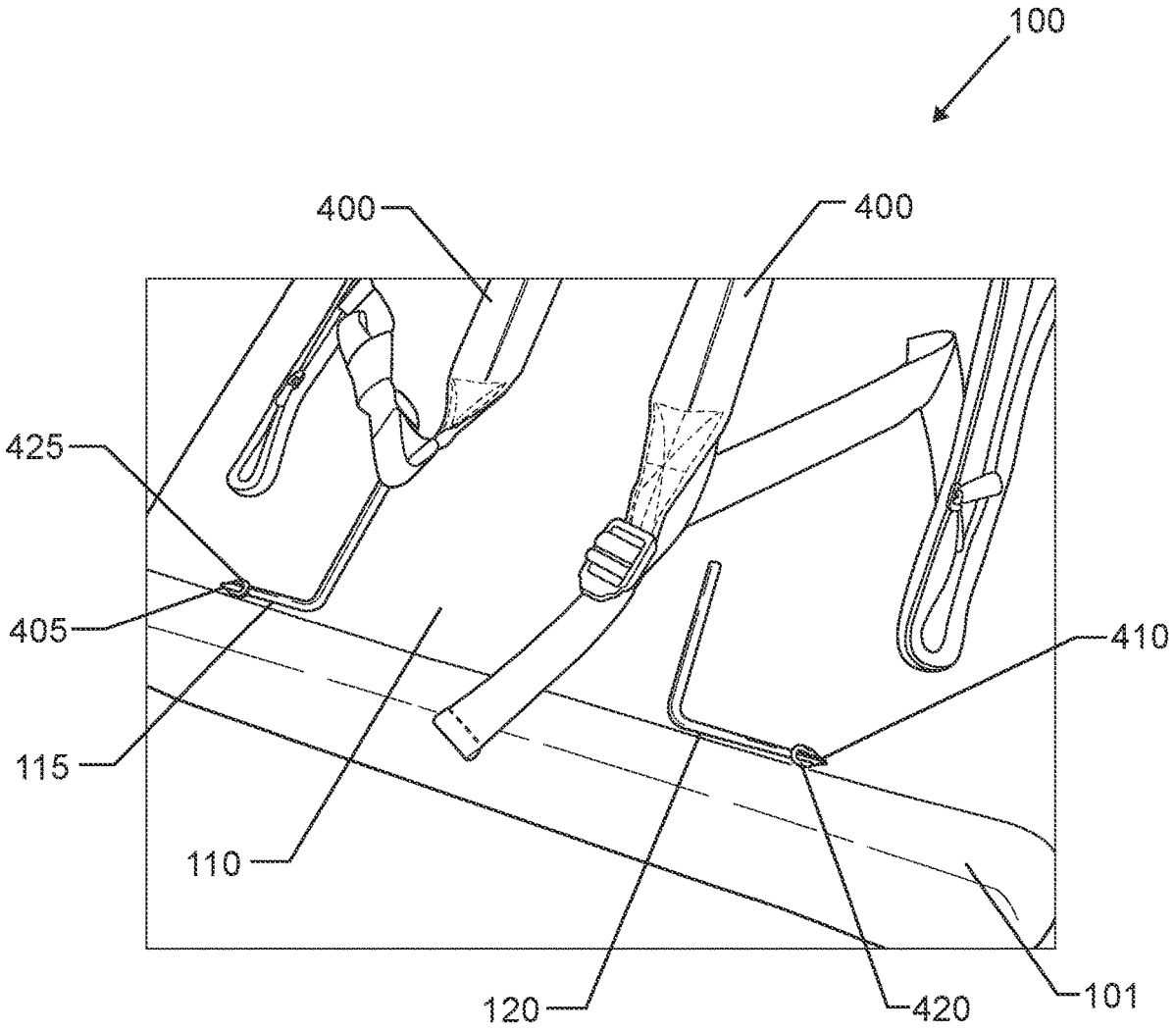
FIG. 4 is an illustration of one embodiment of a portable seat showing its hooks in a flat storage configuration.

FIG. 4 is an illustration of one embodiment of a portable seat showing its hooks in a flat storage configuration. As shown in FIG. 4, the portable seat 100 may comprise one or more straps 400. As shown in FIG. 4, when the hooks 115, 120 are in a flat storage configuration, the hooks 115, 120 may rest (lay flat) against an outside surface of the cover 110. The hooks 115, 120 may traverse one or more holes 405, 410 in the cover 110. The hooks 115, 120 may connect to the internal frame 105 via an anchoring element 700, and held under tension against the cover 105 by a biasing element 705 (see FIGS. 7-10). A hook, 115 or 120, anchoring element 700, and biasing element 705, may be referred together herein as the hook assembly 710.

In a preferred embodiment, the holes 405, 410 may be configured to allow the hooks 115, 120 to traverse them, but not so large so as to allow dirt and other debris from getting under the cover 110. FIG. 4 also shows that guide loops 420, 425 may extend from the biasing elements 705, 706, engage the hooks 115, 120 and translate a biasing force generated by the biasing elements 705, 706 to the hooks 115, 120, such that the guide loops 420, 425, in combination with the biasing elements 705, 706, may apply a force to cause the hooks 115, 120 to substantially lay flat against the cover 110, unless a counter force is applied.

Additionally, straps 400 may be affixed to the cover 110 or some other component of the portable seat 100 in order to more easily move and carry around the portable seat 100.

Figure 5A:
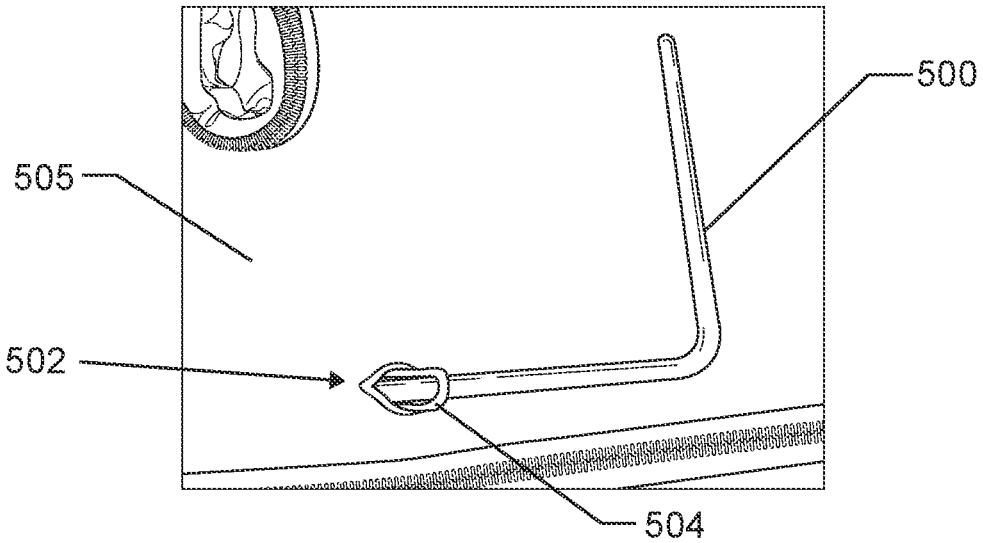
FIGS. 5A-B are illustrations of a close-up view one embodiment of a portable seat showing a hook in a flat storage configuration and deployed configuration
Figure 5B:
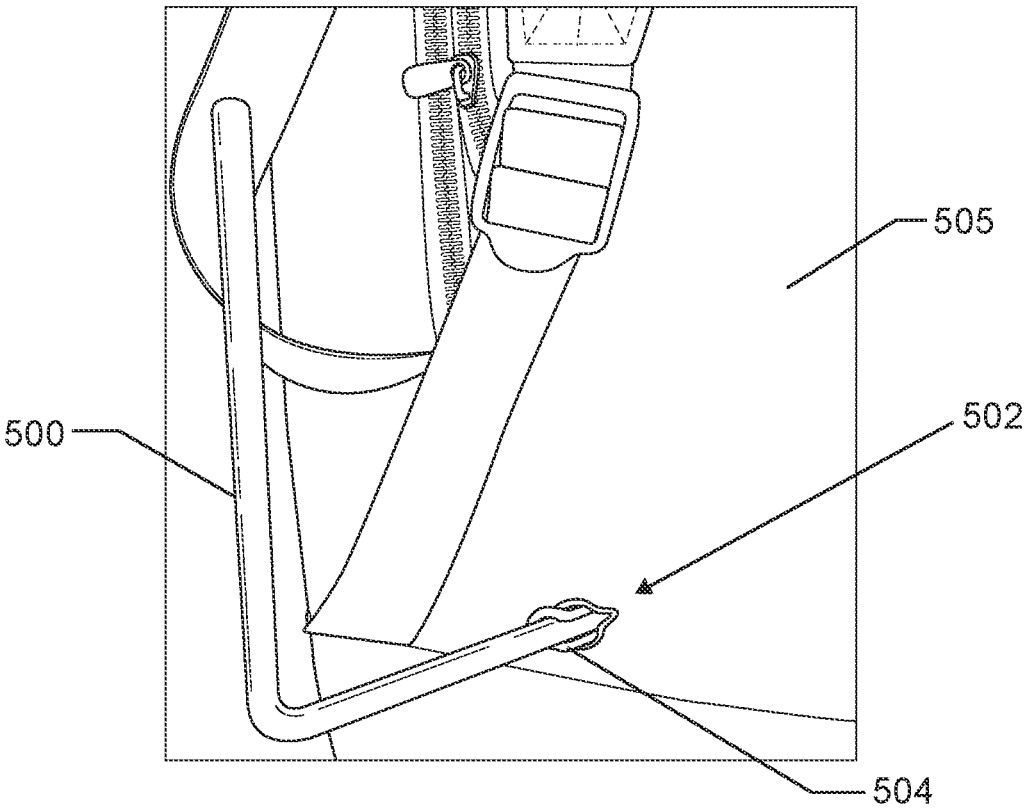

FIGS. 5A-B are illustrations of a close-up view one embodiment of a portable seat showing a hook in a flat storage configuration and deployed configuration. As shown in FIG. 5A, when in a flat storage configuration, a hook 500 may rest against a cover 505. The hook 500 extends through hole 502 and is restrained by the guide loop 504, upon which a force is applied by a biasing element (not shown, similar to 705). In one embodiment, the guide loop 504 may be crimped around the hook 500. As shown in FIG. 5B, when in a deployed configuration, the hook 500 extends orthogonally from the cover 505 and the guide loop 504 may apply a force to the hook 500, such that if a flat surface is within the hook 500, a force is applied to the flat surface through the hook 500 as applied by the guide loop 504. Additionally, in some embodiments, when the portable seat is in a flat storage configuration, the guide loop 504 may apply a force to the hook 500, in the direction of the cover 505. In some embodiments, the guide loop 504 may apply a force to the hook 500, in the direction of the cover 505 regardless of configuration.

Figure 6:
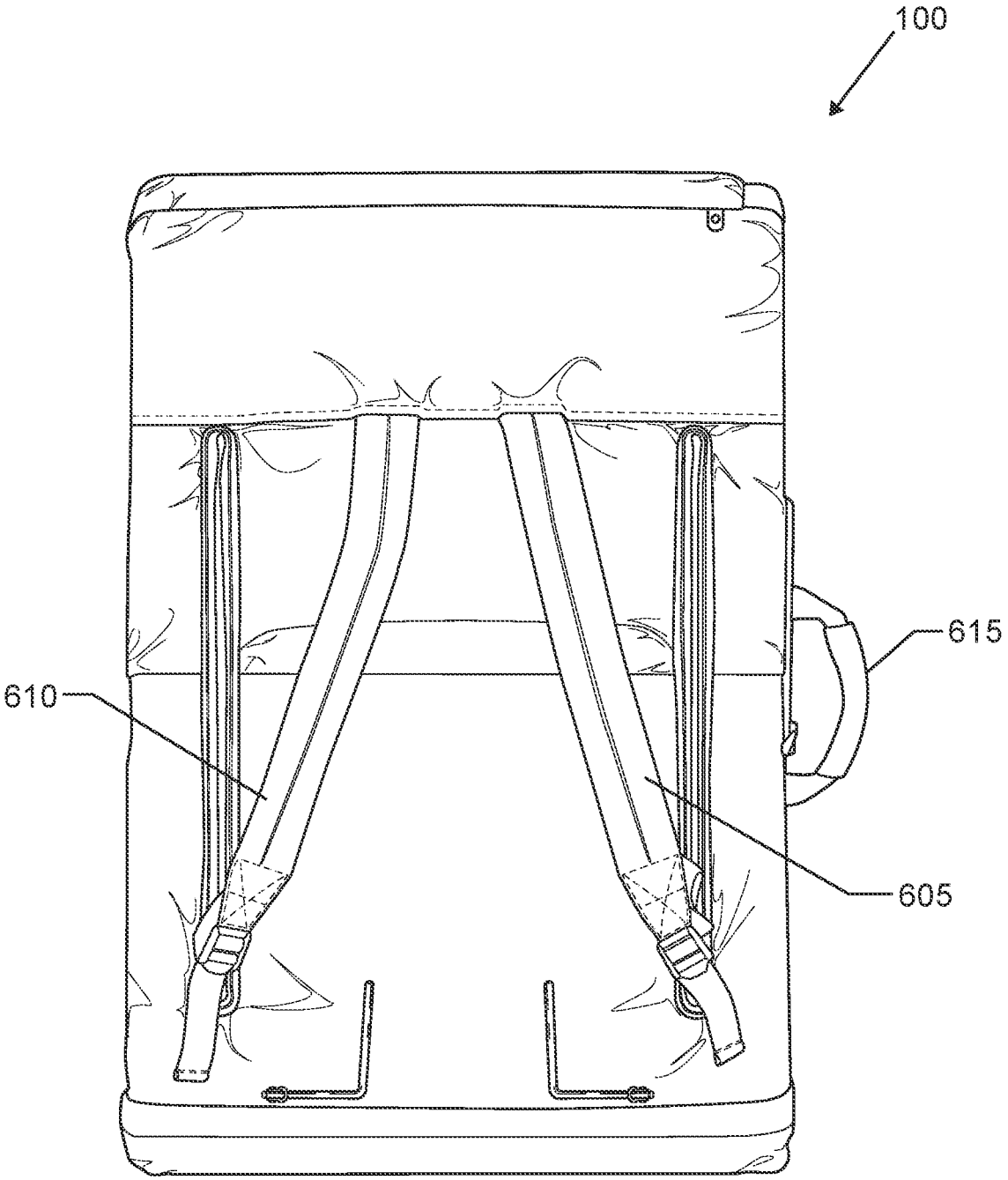
FIG. 6 is an illustration of one embodiment of a portable seat in a flat storage configuration.

FIG. 6 is an illustration of one embodiment of a portable seat in a flat storage configuration. As shown in FIG. 6, the portable seat 100 may be entirely flattened so that it is easy to store and easy to carry. In one embodiment, the portable seat 100 may comprise straps 605, 610 and a handle 615. In alternate embodiments, the portable seat 100 may comprise substantially any other mechanism or strap to make transport of the portable seat 100 easier.

Figure 7:
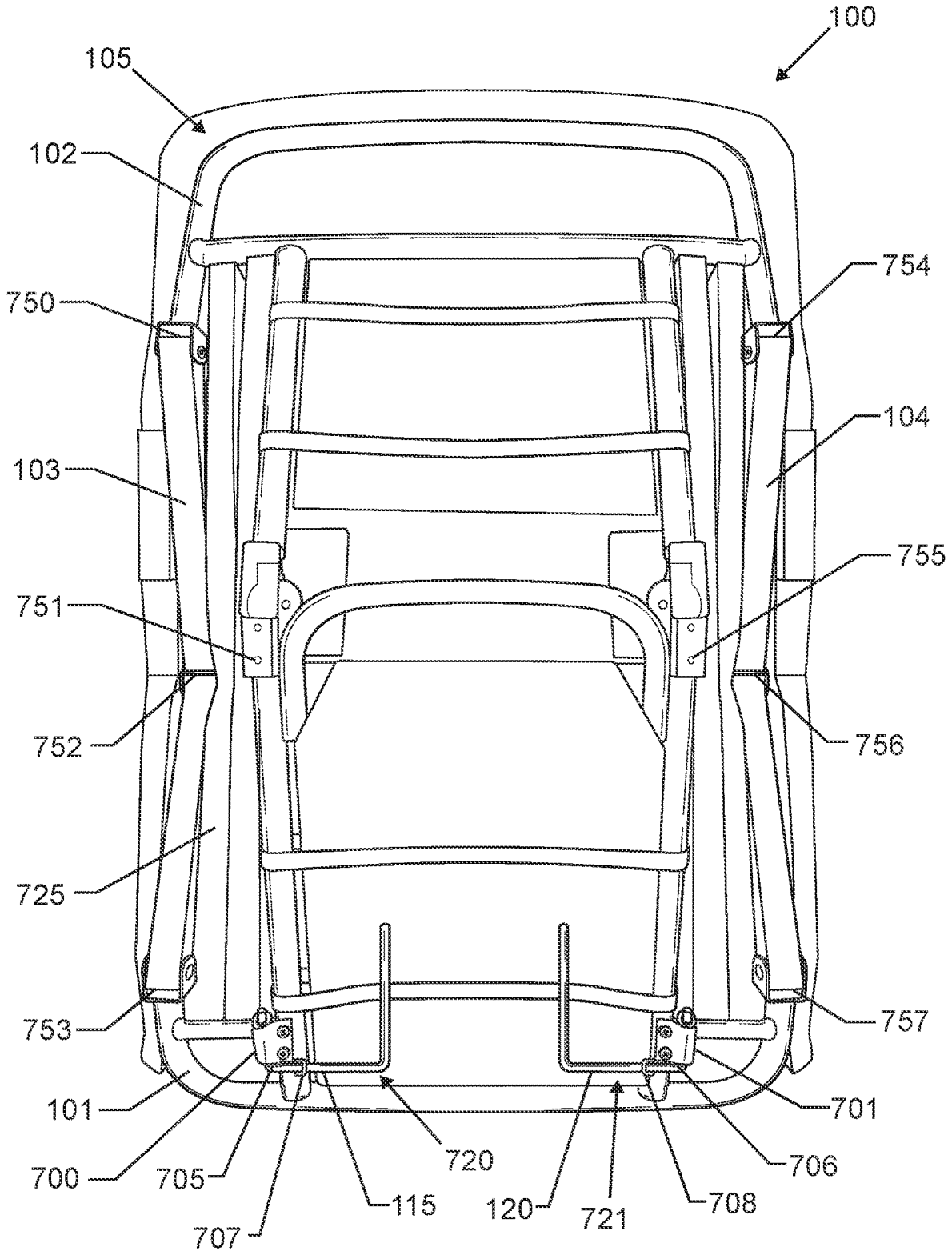
FIG. 7 is an illustration of a rear view of one embodiment of the internal components and hooks of a portable seat in a flat storage configuration without the cover.

FIG. 7 is an illustration of a rear view of one embodiment of the internal components and hook assemblies of a portable seat in a flat storage configuration without the cover. As shown in FIG. 7, the portable seat 100 may comprise an internal frame 105, cushion 725, and first and second hook assemblies 720, 721. The hook assemblies 720, 721 may comprise hooks 115, 120, anchoring elements 700, 701, biasing elements 705, 706, and guide loops 707, 708. The anchoring elements 700, 701 may comprise any mechanical structure or method of affixing the hook assemblies 720, 721 to the internal frame 105. In one embodiment, the anchoring elements 700, 701 may comprise a bracket and screws. In another embodiment, the anchoring elements 700, 701 may comprise a bracket that is welded to the internal frame 105. In alternate embodiments, adhesives or other grappling mechanisms may be used. The guide loops 707, 708 may translate a force generate by the biasing elements 705, 706 to the hooks 115, 120.

The cushion may be substantially any soft material that may be used to increase the comfort of using the portable seat 100.

The internal frame 105 may be substantially any rigid material, including metal, wood, composites, plastic, or any other rigid material. In a preferred embodiment, the internal frame 105 may be made of aluminum, which is relatively strong and light.

In a preferred embodiment, the internal frame 105, cushion 725, anchoring elements 700, 701, and biasing elements 705, 706 may be encased within the cover 110 when the cover is used.

The internal frame may comprise a bottom portion 101, top portion 102, and armrest portions 103, 104. The internal frame 105 may also comprise a plurality of hinges 750, 751, 752, 753, 754, 755, 756, 757. In a preferred embodiment, the hinges 750, 751, 752, 753, 754, 755, 756, 757 may allow the portable seat 100 to switch to and from a flat storage configuration, as shown in FIG. 7, and a seating configuration, as shown in FIG. 8.

Figure 8:
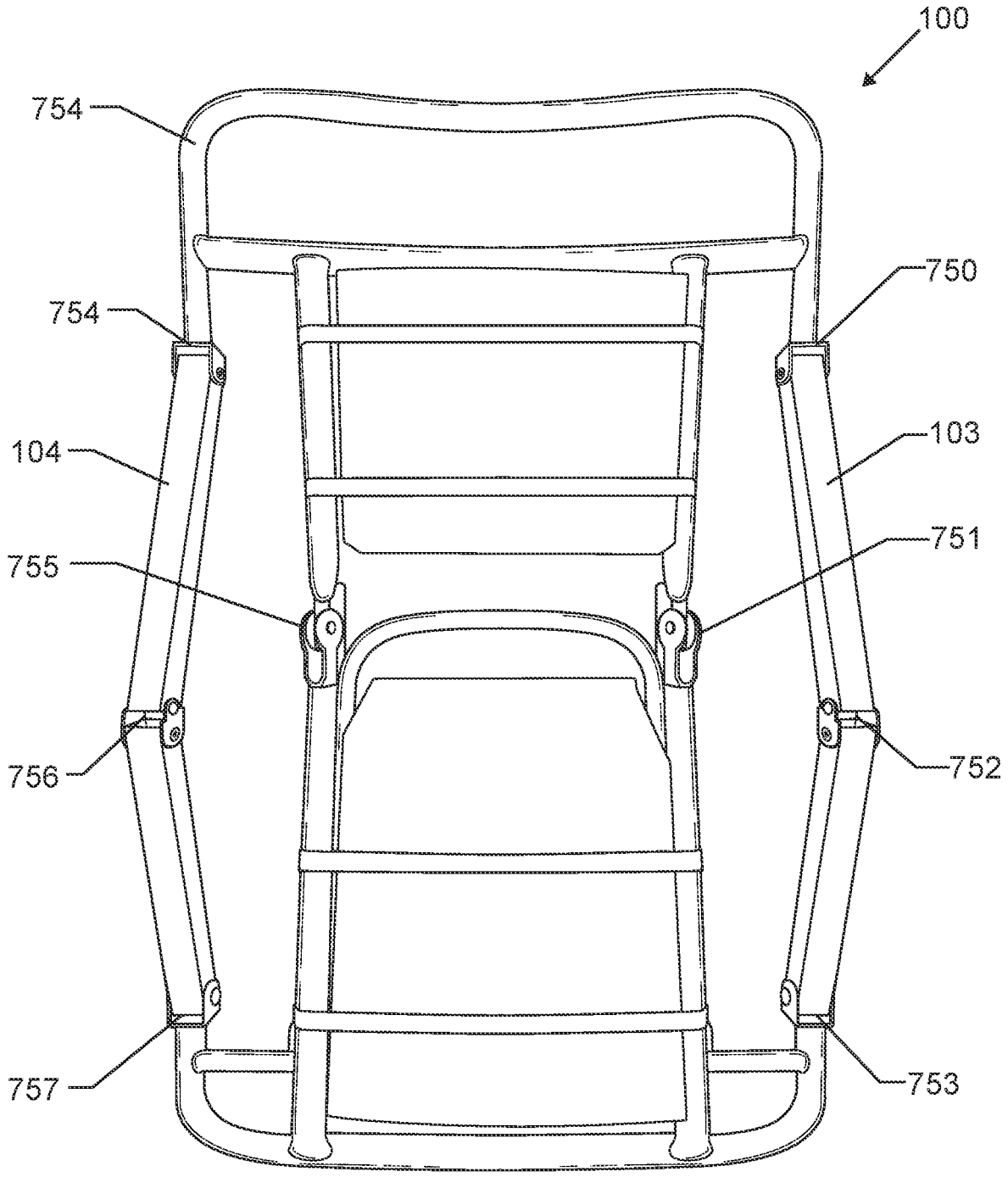
FIG. 8 is an illustration of a front view of one embodiment of the internal components of a portable seat in a seating configuration.

FIG. 8 is a top view of an illustration of one embodiment of the internal components of a portable seat in a seating configuration.

Figure 9:
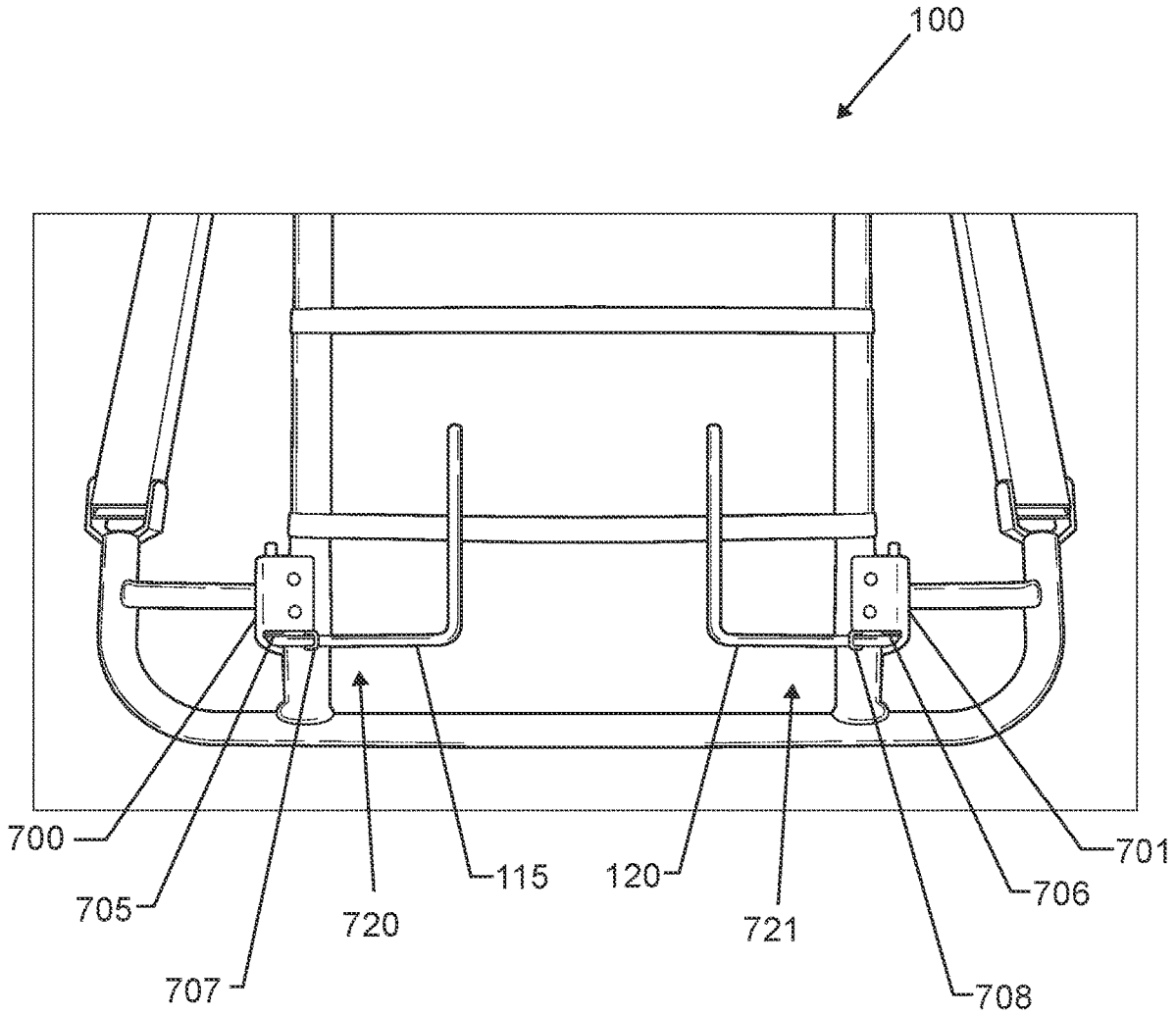
FIG. 9 is an illustration of a rear close-up view one embodiment of a portable seat showing part of its internal frame and hook assemblies.

FIG. 9 is an illustration of a rear perspective close-up view one embodiment of a portable seat showing part of its internal frame and hook assemblies.

Figure 10:
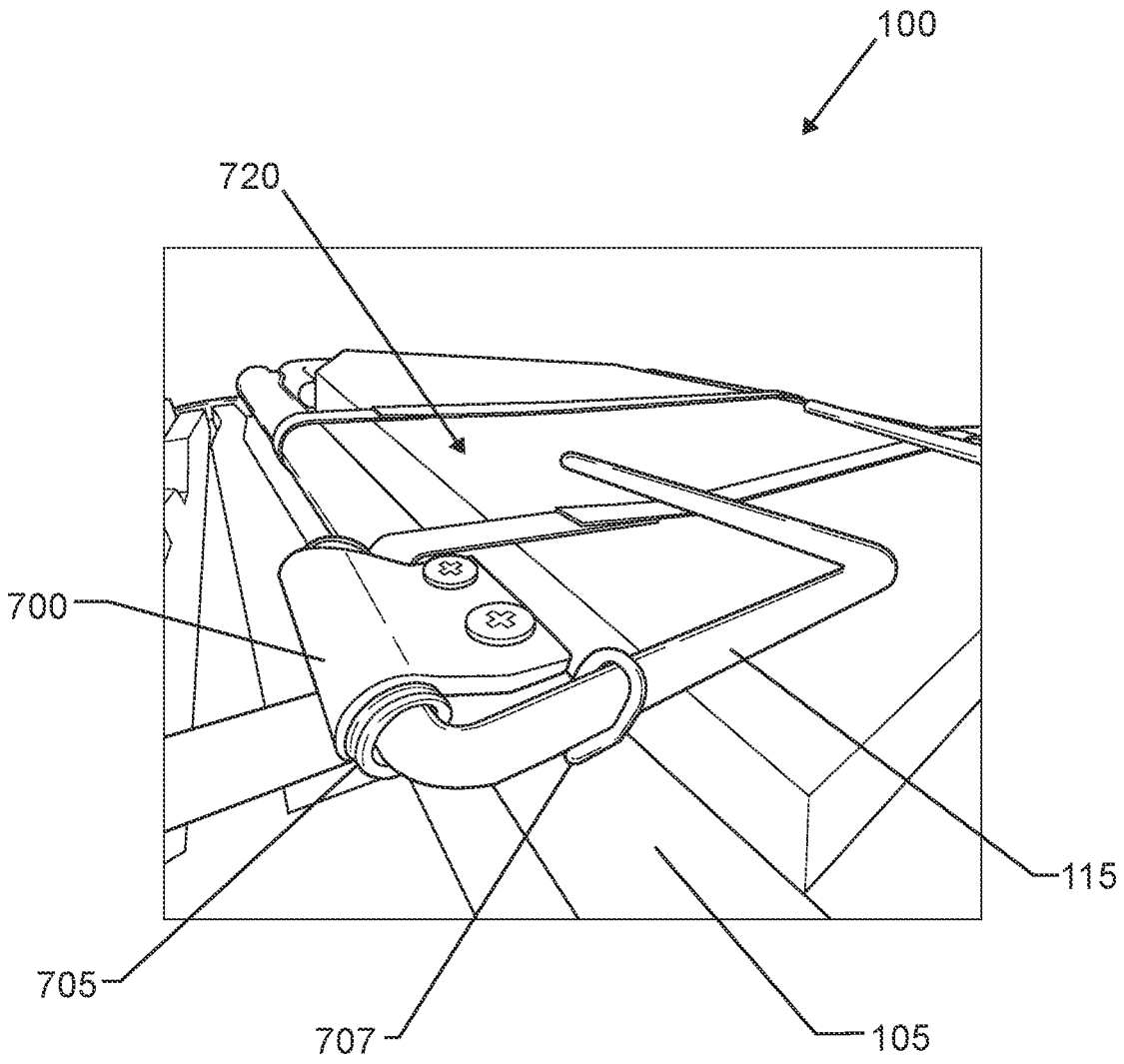
FIG. 10 is an illustration of a close-up view one embodiment of a portable seat showing part of its internal frame and hook assemblies.

FIG. 10 is an illustration of a close-up view one embodiment of a portable seat showing the hook assemblies. As shown in FIG. 10, the first hook assembly 720 may comprise the hook 115, anchoring element 700, and biasing element 705. The anchoring element 700 may consist of a bracket and screws configured to secure the hook 115 to the internal frame 105. The biasing element 705 may be a coiled metal, or spring, and apply a force upon the hook 115 through a guide loop 707 such that the hook 115 is at rest when flat against the portable seat 100. In some embodiments, the first hook assembly 720 may be considered "spring-loaded".

In alternate embodiments, the biasing element 705 may be substantially any structure or material in any configuration that applies a force to the hook 115 sufficient to cause the hook 115 to lay flat or substantially flat against the portable seat 100 when no other forces act on the hook 115, but weak enough that the hook 115 may be manipulated by a user. The hook 115 may be maneuvered into a deployed position, as shown in FIG. 5B. When in a deployed position, the biasing element 705, which holds the hook 115 in a flat storage configuration, is overcome. The biasing element 705 and guide loop 707 may then hold the hook 115 in the deployed configuration until the user forces the hook 115 back down into the flat storage configuration.

In a preferred embodiment, the anchoring element 700 securely affixes the hook 115 to the internal frame 105.

As shown in FIG. 10, the hook 115 may be a U or substantially U shaped.

In one embodiment, the location where the anchoring element 700 engages the internal frame 105 may be considered the engagement area.

In one embodiment, the second hook assembly 721 functions substantially similar to the first hook assembly 720. In some embodiments, the second hook assembly 721 and first hook assembly 720 are mirrored versions of one another.

The foregoing description of the specific embodiments will so fully reveal the general nature of the present disclosure that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments of the present disclosure have been described in terms of preferred embodiments, those skilled in the art will recognize that the embodiments of the present disclosure may be practiced with modification within the spirit and scope of the appended claims.

Unless otherwise stated, all measurements, values, ratings, positions, magnitudes, sizes, locations, and other specifications which are set forth in this specification, including in the claims which follow, are approximate, not exact. They are intended to have a reasonable range which is consistent with the functions to which they relate and with what is customary in the art to which they pertain.

The foregoing description of the embodiments has been presented for the purposes of illustration and description. While multiple embodiments are disclosed, still other embodiments will become apparent to those skilled in the art from the above detailed description. As will be realized, these embodiments are capable of modifications in various obvious aspects, all without departing from the spirit and scope of the protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that these embodiments not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

The invention claimed is:

1. A portable seat, comprising:

an internal frame;

a cushion;

one or more carrying straps;

a cover; and one or more hook assemblies;

wherein said internal frame is encased by said cover;

wherein each of said one or more hook assemblies comprise a hook, a biasing element, and an anchoring element;

wherein said one or more hooks are configured to move between a storage configuration and deployed configuration; and wherein said one or more hook assemblies engage said internal frame at an engagement area via said anchoring elements;

wherein said cover comprises one or more holes through which said one or more hooks traverse;

wherein said one or more holes are not configured to be sealed;

wherein said one or more biasing elements are configured to apply a force to said one or more hooks such that said one or more hooks pivot at said engagement area;

wherein when said one or more hooks are in said storage configuration, they are held substantially in place against said cover by said one or more biasing elements;

wherein when said one or more hooks are in said deployed configuration, they are held substantially in place extending orthogonally away from said cover by said one or more biasing elements;

wherein said one or more hooks are configured to engage a front surface of a bench when said one or more hooks are in a deployed configuration;

wherein said cushion is encased within said cover;

wherein said internal frame is metal; and wherein said carrying straps are affixed to an outside surface of said cover.

2. The portable seat of claim 1, wherein said internal frame comprises a plurality of hinges, such that said portable seat comprises a flat configuration and a seated configuration; and wherein said internal frame comprises a lower portion, upper portion, and armrest portions.

* * * * *